US007028373B2

(12) United States Patent
Harmon et al.

(10) Patent No.: US 7,028,373 B2
(45) Date of Patent: Apr. 18, 2006

(54) SPRING BIASED HINGES AND METHODS THEREFOR

(75) Inventors: Roger W. Harmon, Crystal Lake, IL (US); Michael F. Spence, Libertyville, IL (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 10/439,481

(22) Filed: May 16, 2003

(65) Prior Publication Data

US 2004/0226138 A1 Nov. 18, 2004

(51) Int. Cl.
*E05F 1/14* (2006.01)

(52) U.S. Cl. ..... 16/284; 16/286; 16/290; 16/334

(58) Field of Classification Search ..... 16/284, 16/286, 280, 281, 290, 334, 335; 361/680, 361/681, 682, 683; 379/433, 434; 455/575.1, 455/550.1, 344, 348
See application file for complete search history.

(56) References Cited

U.S. PATENT DOCUMENTS

| | | | | |
|---|---|---|---|---|
| 938,952 | A | 11/1909 | Berg | |
| 3,644,023 | A | 2/1972 | Villani | |
| 3,837,735 | A | 9/1974 | Guillet | |
| 3,957,360 | A | 5/1976 | Villani | |
| 4,424,606 | A * | 1/1984 | Sorimachi | 16/223 |
| 4,884,317 | A * | 12/1989 | Liu | 16/289 |
| 4,897,873 | A | 1/1990 | Beutler et al. | |
| 5,515,575 | A * | 5/1996 | Pinazza | 16/228 |
| 5,640,690 | A | 6/1997 | Kudrna | |
| 5,704,094 | A * | 1/1998 | Hartigan et al. | 16/303 |
| 5,815,790 | A * | 9/1998 | Billgren et al. | 419/5 |
| 5,815,899 | A * | 10/1998 | Chao | 29/20 |
| 6,393,664 | B1 | 5/2002 | Habegger et al. | |
| 6,684,456 | B1 * | 2/2004 | Lee | 16/342 |
| 6,745,436 | B1 * | 6/2004 | Kim | 16/330 |

FOREIGN PATENT DOCUMENTS

| | | | |
|---|---|---|---|
| FR | 2644902 | A1 * | 9/1990 |
| GB | 2099912 | A * | 12/1982 |
| GB | 2338027 | A * | 12/1999 |
| JP | 03228986 | A * | 10/1991 |

* cited by examiner

*Primary Examiner*—Chuck Y. Mah
(74) *Attorney, Agent, or Firm*—David S. Noskowicz

(57) ABSTRACT

A hinged housing portion (110) coupled to a second housing portion (120), for example in a wireless communications device, including a compression spring (134) coupled to one of the housing portions, a cam (142) coupled to the body member, and a follower (336) coupled between the cam and the compression spring. The compression spring compresses along a compression axis perpendicular to the axis of rotation. The contoured surface or cam surface urges the follower against a first side of the second housing portion with the follower force 724. The follower force is parallel to the slope of the contoured surface slope at the point of contact between the follower and the contoured surface. The follower force results in rotation of the second housing portion in a first direction or second direction of rotation about the first axis depending on the angle of the contoured surface relative to the compression spring axis.

16 Claims, 9 Drawing Sheets

SPRING BIASED HINGES AND METHODS THEREFOR

FIELD OF THE INVENTION

The present invention relates generally to electronics devices having spring biased hinges, and more particularly to portable wireless handsets having hinged housing portions, for example mobile wireless communications handsets, spring biasing mechanisms, and methods therefor.

BACKGROUND OF THE INVENTION

Wireless cellular communications devices having hinged flip portions are known generally. For example, a compression spring biased cam that engages a cam follower to pivot a housing member, such as a cover or flip portion, about an axis of rotation that is in the same plane as the compression spring is known.

Wireless or portable communication devices continue to add features while maintaining or even reducing the device size to promote portability. The existing hinges of folding devices take up space within the housing, which reduce the amount of already limited space that is available for the incorporation of other desirable features. Control over the motion of the relative housing portions is also limited. Additionally, the incorporation of an auto open feature is limited, takes up valuable space within the device or is not possible with the existing hinge assemblies.

Some hinges force a spring urged follower into a detent cam, positioning the two elements at various angles relative to one another, based on the position of the detent. These hinges, however, do not control the motion of one element relative to the other element.

The various aspects, features and advantages of the present invention will become more fully apparent to those having ordinary skill in the art upon careful consideration of the following Detailed Description of the Invention with the accompanying drawings described below.

DETAILED DESCRIPTION OF THE INVENTION

Figure 1:
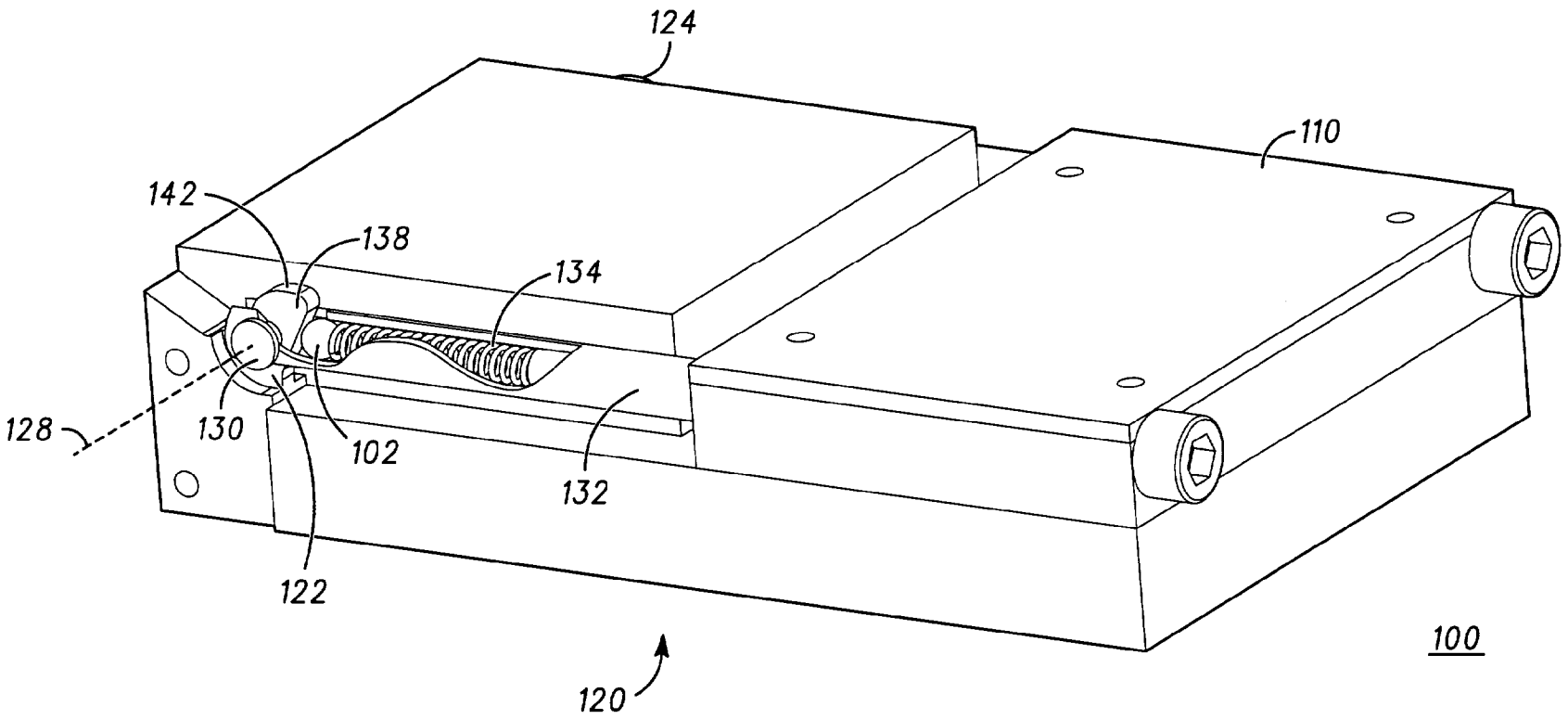
FIG. 1 is an exemplary electronics device having a hinge.

FIG. 1 illustrates an exemplary electronic device 100 having a first housing portion or cover 110, for example a cellular phone flip, pivotally coupled to a housing or housing portion 120, for example a cellular handset housing. In the exemplary embodiment, the electronics device 100 is a wireless communications handset. A spring biased hinge portion, coupled between the cover 110 and the housing portion 120, affects the motion of the cover 110 relative to the housing portion 120. However, the hinges and spring biasing mechanisms of the present invention may be used more generally in any application where it is desirable to provide a spring-biased hinge, as will become more fully apparent from the discussion below.

Figure 2:
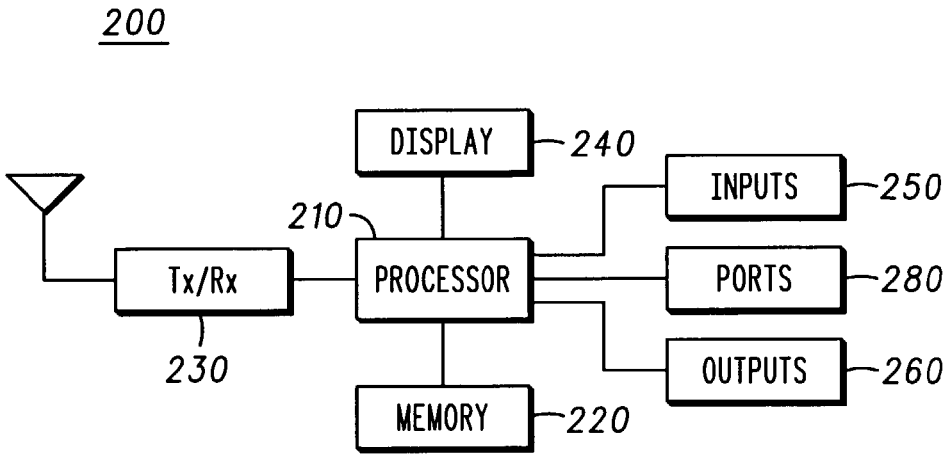
FIG. 2 is an exemplary wireless communications handset schematic block diagram.

FIG. 2 is an exemplary wireless communications handset schematic block diagram 200 comprising generally a processor 210 coupled to memory 220, for example RAM, ROM, EPROM, etc. The exemplary wireless handset also includes a radio transceiver 230, a display 240, inputs 250, for example a keypad, a microphone and video inputs, outputs 260, for example a sound and tactile or haptic outputs, and other ports 270, for example power, audio, etc., all of which are coupled to the processor.

The various elements of the exemplary wireless handset, for example the processor, memory, inputs, outputs are disposed generally in a housing. The display is often mounted on the housing whether it is a part of a one piece assembly, or a multiple piece assembly where the housing elements move relative to one another. The housings may also include a keypad or keypads. The location and arrangement of these exemplary wireless handset elements is only an exemplary application and is immaterial to the structure of the hinges and spring biasing mechanisms, which are discussed more fully below.

In FIG. 1, the exemplary housing portion 120 includes a protruding first hinge support member 122 and a protruding second hinge support member 124 each having a contoured surface portion 138. The cover 110 is pivotal about a common pivot axis 128 extending through a portion of the first and second support members (122, 124). A hinge pin 130 pivotally couples the cover 110 to the housing portion 120. A second hinge pin (not shown in FIG. 1) couples the cover 110 to the housing portion 120 on the opposite side of the housing portion 120. In other embodiments, the panel may be coupled to the housing by alternative pivotal coupling schemes, for example by a common pivot member or shaft.

Figure 3:
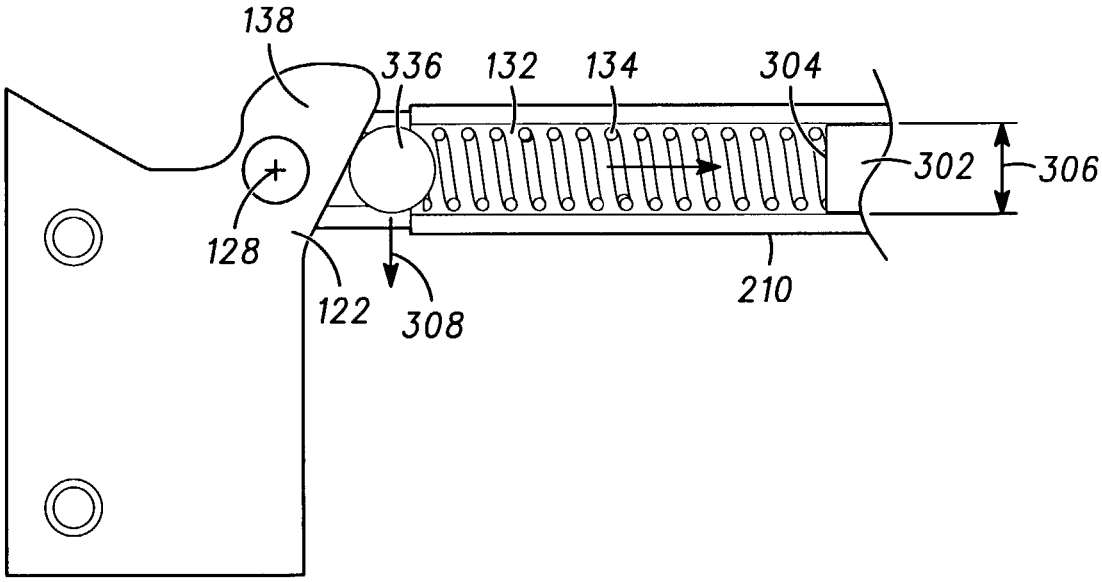
FIG. 3 is an exemplary portable electronics device having a hinged portion.

In one exemplary embodiment, shown in both FIG. 1 and the exemplary cross section of FIG. 3, the cover 110 has a first hollow portion 132. The hollow portion 132 is coupled to the first support member 122 such that at least a portion of the contoured surface portion 138 is enclosed or surrounded by the hollow portion 132. A cam follower assembly comprises the contoured surface portion 138, a follower 102 and a yielding element 134. The yielding element 134 is enclosed in the hollow portion 132 having a yielding element force when compressed. The yielding element 134 yields to a follower in response to changes in the contoured surface portion 138 as the cover 110 is pivoted about the common pivot axis 128. In the embodiment shown in FIG. 1, a compression spring 134 is the yielding element, and is compressably disposed in the hollow portion 132. The compression spring 134 is compressible along a compression axis 302 of the compression spring 134 within the hollow portion 132. The follower 102, which is a ball bearing 336 in one exemplary embodiment, is disposed in the hollow portion 132 in-between the compression spring 134 and a contoured surface portion 138. The yielding element is disposed such that it applies a force to the follower 102 wherein the follower 102 remains coupled to the contoured surface portion at all points along the contoured surface portion 138.

The cover 110 is either stationary at selected positions relative to the housing portion 120 or rotating relative to the housing portion 120. Consequently, the follower 102 will either remain stationary or traverse across the contoured surface portion 138 as the cover 110 rotates about the first axis 128. The cam follower assembly is one source of force acting on the cover 110. The rotation of the cover 110 is a result of the force of the follower 336 on the cover 110 as the follower 336 moves across the contoured surface portion 138. The motion of the follower 336 across the contoured surface portion 138 is at least a function of the yielding element force and the slope of the contoured surface portion relative to the cover 110. The force of the yielding element 134 and the angle of the slope of the contoured surface portion 138 relative to the direction of the yielding element force, determines the magnitude of the force acting on the cover 110 by the yielding element via the follower 336.

As the yielding element force urges the follower 336 toward the contoured surface portion 138, the contact between the follower 336 and the contoured surface portion 138 creates two component forces. These two component are perpendicular to one another, and reactive to the yielding element force. When the angle or slope of the contoured surface portion 138 is not perpendicular to the yielding element force a first component of the reactive force is created and acts parallel to the contoured surface portion 138 thereby urging the follower 336 to traverse the contoured surface portion 138. Consequently the follower 336 in turn applies a force against the cover 110. A second component force reacts in a direction which is 180 degrees, or substantially opposite to the yielding element force.

The opposing end of the compression spring 134, is held fixed at a position along the hollow portion 132 by an end of the hollow portion 132 or a fixturing element within the hollow portion 132 such as a wall or screw or bracket or combination thereof, within the hollow portion 132. The hollow portion 132 of the cover 110 may be an arm 310, or the like, extending from a portion of the cover 110 to the first support member 122 as shown in the exemplary embodiment of FIG. 1. In one embodiment, the arm 310 is a tube having the hollow portion 132. The outside dimensions of the hollow portion 132 or arm 310 does not have to resemble a tube like structure, as long as the yielding member in the hollow portion 132 is free to travel in a direction along the compression axis 302 and in response to the urging force of the cam follower action assembly. This cam follower assembly is completely external to the housing portion 120 leaving more space within the housing portion 120 for other desired components.

Figure 4:
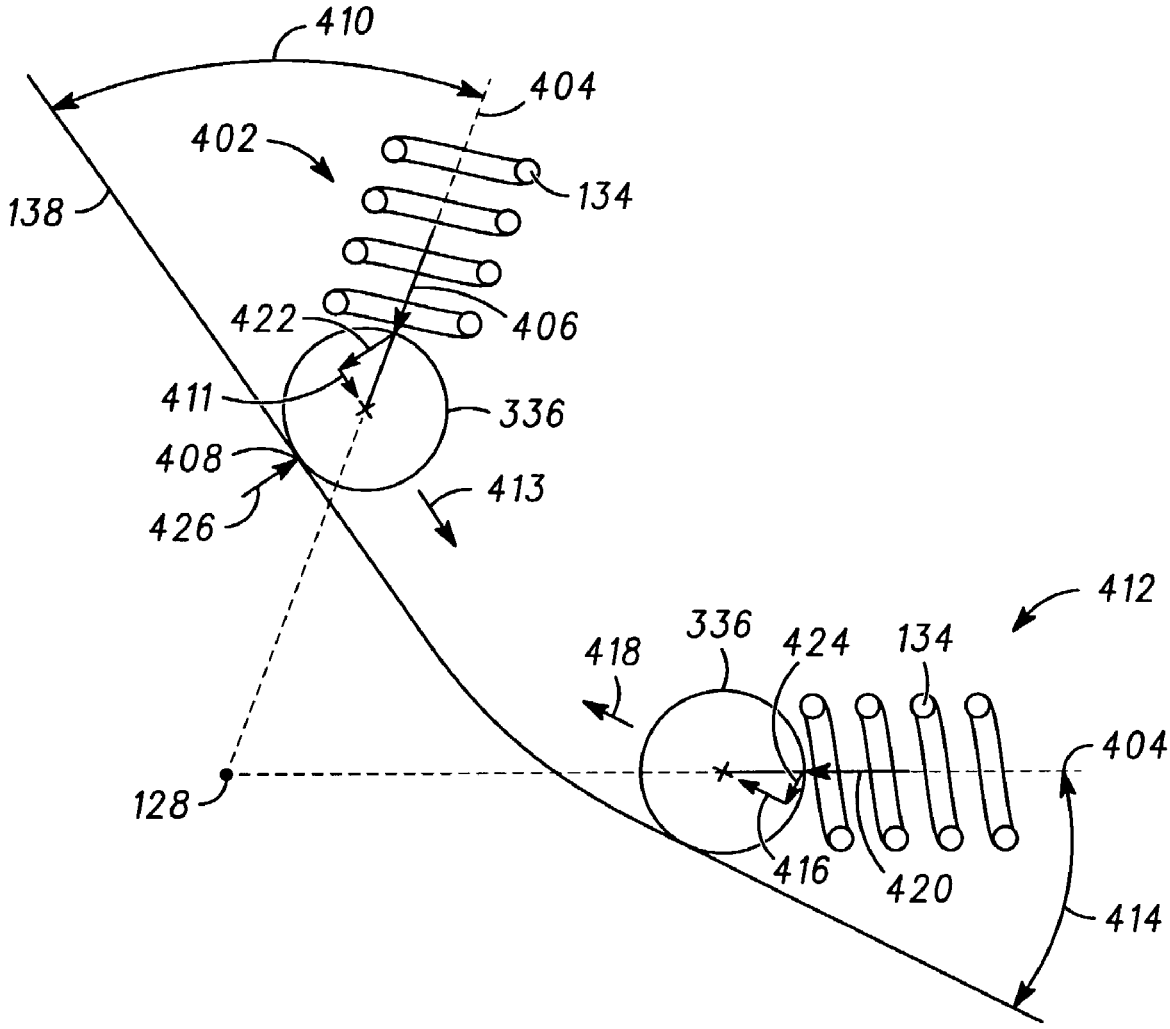
FIG. 4 is an exemplary free body diagram illustrating exemplary forces of the cam follower assembly.

The force diagram, shown in FIG. 4 illustrates the yielding element force and the resulting or reactive force 426 on the follower 336 as a result of both the yielding element force and the slope of the contoured surface portion 138. FIG. 4 shows the follower 336 in a first position 402. The yielding element force 406 acts along the compression axis 404 urging the follower 336 toward the contoured surface portion 138. The follower 336 contacts the contoured surface portion 138 at a first contact point 408 where the slope has a first angle 410 relative to the compression axis 404. The application of the yielding element force 406 to the follower 336, which is in contact with the first angle 410, results in a first parallel force 411 parallel to the contour surface portion 138, at the point of contact for the first position 408. The first parallel force 411 causes the follower to traverse across the contoured surface portion in a first direction 413 of the first parallel force 411.

Also shown in FIG. 4 is the follower 336 in a second position 412. At the second position 412, the angle of the slope is a second angle 414 relative to the compression spring axis 404. In this configuration, the second parallel force 416 acts on the follower 336, and because of the second angle 414 the follower traverses in a second direction 418, substantially opposite to the first direction 413. The magnitude of the compression spring force 406 in the first position 402, may or may not be the same as the compression spring force 420 in the second position 412. The direction of the traveler is dependent upon the angle of the contoured surface portion slope. A force substantially perpendicular to the to the contoured surface, a first perpendicular force 422 at the first position 402 and a second perpendicular force 424 at the second position 412, urges the follower to maintain contact with the contoured surface portion 138.

Figure 5:
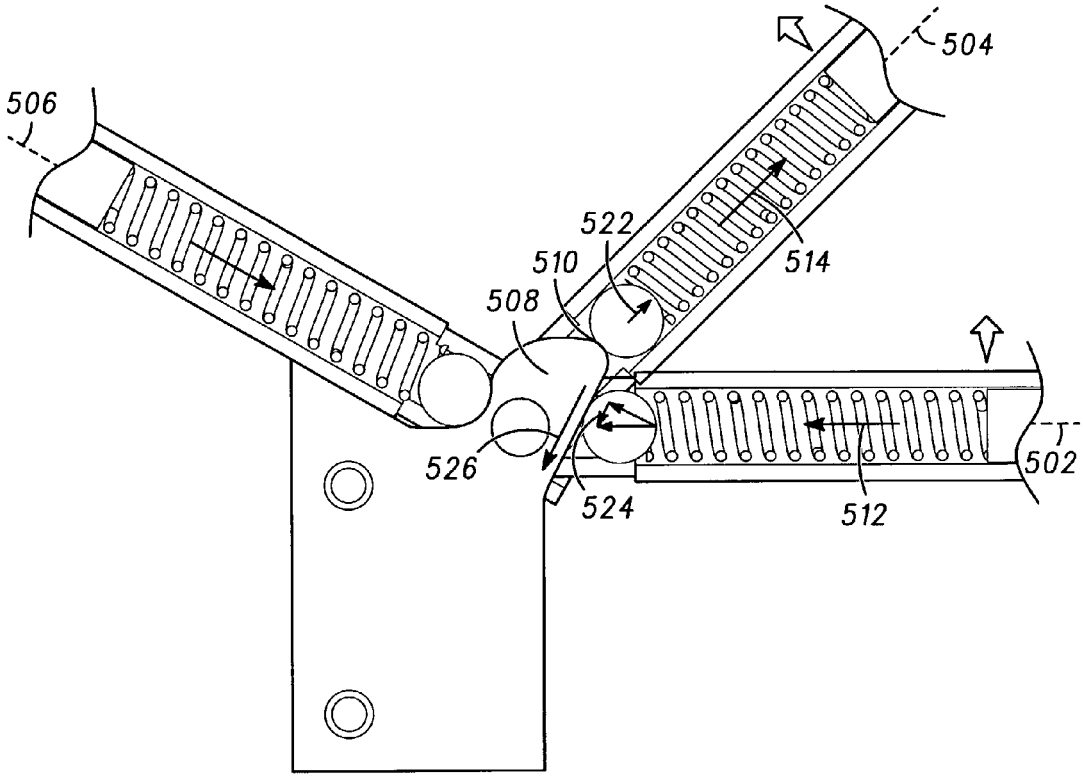
FIG. 5 is an exemplary portable electronics device having a hinged portion in multiple exemplary positions.

As illustrated in FIG. 5, one embodiment of the present invention comprises the hollow portion 132 of the arm 310 of the cover 110, which pivots or rotates about the first axis 128. FIG. 5 illustrates the interaction between the arm 310, the ball bearing 336, the cam surface 142 and the compression spring 134 as the arm 310 rotates relative to the housing portion 120 about the first axis 128. The cover 110 and consequently the arm 310 attached thereto, pivot from a first position 502 to a second position 504, for example about the first axis 128. As the cover 110 pivots about the first axis 128, the follower, or ball bearing 336 in the illustrated embodiment, rolls or slides along a cam surface 142 of the cam 138 while being urged against the cam surface 142 by the compression spring 134. The angle of the cam surface 142 relative to the arm 310 and the compression spring axis 302 changes as the contour of the cam surface 142 changes.

When the angle of the cam surface 142, at the point of contact with the ball bearing 336, is perpendicular to the compression spring axis 302, such as at position 504, a reactive force 522 of the cam surface 142 on the ball bearing 336 is substantially opposite and parallel to the force of the compression spring 142. As the angle of the cam surface 142 changes relative to the compression spring axis 302, such as at position 502, a lateral component reactive force 524 results. This lateral component reactive force 524 is parallel to the cam surface 142 at the point of intersection of the cam surface 142 and the ball bearing 336. The lateral component reactive force 524 urges the ball bearing 336 to move along the cam surface 142 in the direction illustrated by the first arrow 526 of the lateral component reactive force 524. As the ball bearing 336 is urged in the direction of the lateral component reactive force 524, the ball bearing 336 exerts a follower force 308 on the arm 310, causing the arm 310 to rotate about the first axis 128.

As the cover 110 rotates about the first axis 128, the compression spring 134 compresses or decompresses in response to the shape of the cam surface 142 maintaining the force on the ball bearing 336. As the arm 310 rotates from the first position 502 on the cam surface 142 to second position 504 on the cam surface 142, the distance between the cam surface 142 and the rotation axis 128 of rotation changes, resulting from a varying contour of the cam surface 142. This change in distance, or contour, causes the compression spring 134 to compress and decompress a varying amount as the ball bearing 336 moves along the cam surface 142 and moves longitudinally within the hollow portion 132 of the arm 310 in the direction of the compression spring axis 302. The follower force 308, exerted by the ball bearing 336 on the hollow portion 132, causes the cover 110 to rotate about the first axis 128. The follower force 302 is applied against the side of the hollow portion 132 a distance away from the first axis 128 resulting in a torque that rotationally biases the arms of the cover 110. The magnitude of the torque is a function of the lateral component reactive force 524, which is a function of the angle or slope of the cam surface 142 relative to the arm and the force due to the compression spring 134 which is expressed mathematically by the equation:

$$T=F*D$$

The contour of the cam surface 142 dictates the amount of compression and correspondingly the force the compression spring 134 applies against the cam follower assembly at the various positions along the cam surface 142. The variation in force creates the torque profile. The contour of the cam surface 142 can be shaped to achieve a desired torque profile having specific desired values at particular points along the cam surface 142 and hence at different points of rotation of the cover 110 relative to the housing portion 120. This allows the designer to vary the torque profile, via the cam surface 134 that ultimately affects the force applied to the cover 110 at the different points of rotation. For example in one exemplary embodiment, the cam surface 142 is shaped similar to a triangle 508 having a rounded tip portion 510. The rounded tip portion 510 allows the follower to traverse more easily over the cam surface 142. At the first position 502 in FIG. 5, the compression spring begins to exert a force 512. This can be a nominal force where the compression spring 134 is in a resting or at a near equilibrium position, or a force less than the maximum force achieved when the compression spring 134 is compressed all the way. However, the spring force 512 at the first position 502 cannot be the maximum spring force, in this embodiment as this would prevent the compression spring 134 from compressing further, and consequently preventing the arm 310 from rotating. In the preferred embodiment the compression spring 134 exerts a different force 514, at the point along the cam surface 142 that forms the rounded tip 510 of the cam surface 142. In-between the first position 502 and the second position 504, the compression spring 134 compresses further and correspondingly generates an increasing amount of force until it reaches the second position 504. It should be noted that other forces are associated with other rotational positions other than the ones specifically exemplified in FIG. 5. One skilled in the art will appreciate the correlation between the position of the arm and the resulting force due to the relative amount of spring compression with in the cam follower assembly.

The resulting torque produced by the force applied to the cover 110 by the cam follower assembly is such that just prior to the arm reaching the second position 504 (i.e. before the follower 336 meets the rounded tip 510 of the cam surface 142) the force of the compression spring 134 urges the ball bearing 336 to travel along the cam surface 142 in a direction away from the rounded tip 510 of the cam surface 142, and back toward the first position 502. As a consequence, this force biases the arm 310 in a direction that will rotate the cover 110 toward the first position 502. In one embodiment, a first physical stop 521 prevents the arm 310 from rotating beyond the first position 502. Similarly a second physical stop 520, associated with the travel of the arm 310 between the second position 520 and a third position 506, holds the arm 310 in the third position 506. Coincidentally, the contour of the cam surface 142 at the first position 502 is such that the cover 110 is biased towards the housing portion 120 with enough force to maintain contact or closure of the cover 110 relative to the housing portion 120 until lifted by the user. This can also be independent of or in conjunction with the first physical stop if present.

Similarly, once the cover 110 is rotated past the second position 504 (i.e. the ball bearing 336 moves beyond the rounded tip 510 of the cam surface 142 at the second position 504, the force 513 produced by the spring 134 urges the ball bearing 336 to move away from the second position 504 toward the third position 506 which coincides with the open position of the cover 110 relative to the housing portion 120. This is but one example of topology of the cam surface 142 that creates one possible desired motion of the cover 110. Other exemplary contoured surfaces will be discussed below.

Figure 6:
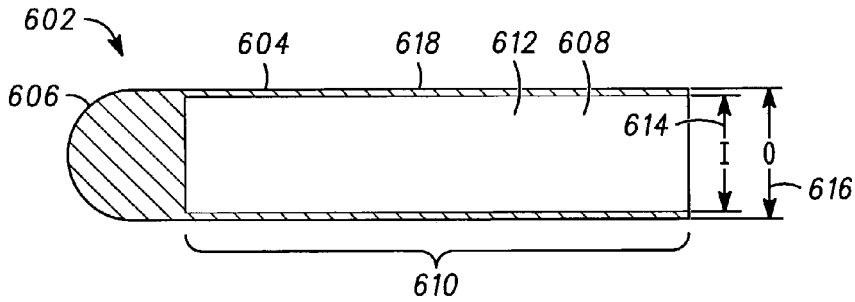
FIG. 6 is an exemplary cross sectional view of a hinge follower.

In another exemplary embodiment, shown in FIG. 6, the follower is a sleeve follower 602. The sleeve follower 602 has a sleeve portion 604 and a rounded portion 606 located at one end of the sleeve portion 604. The rounded portion 606 is the portion of the sleeve follower 602 that contacts the cam surface 142 traversing the cam surface 142 as the cover 110 is rotated about the axis 128. In one exemplary embodiment, the rounded portion 604 is a hemisphere which allows the rounded portion 606 to adequately slide across the cam surface 142. The sleeve portion 604 is cylindrical and has an outer diameter 616, which is smaller than the inner diameter 306 of the hollow portion such that the sleeve portion 604 slides longitudinally in the hollow portion 132 through the sleeve opening 612. The sleeve portion 604 has a sleeve cavity 608 that has an inner diameter 614, which is larger than the outer diameter of the compression spring 134 such that the compression spring 134 fits within the sleeve portion 604. The sleeve portion 604 has a sleeve length 610 that is less than the hollow portion 132 allowing the sleeve portion 604 to slide longitudinally within the hollow portion 132. The compression spring 134 compresses and at least a portion thereof is enclosed within the sleeve portion 604. As the sleeve follower 602 travels longitudinally within the hollow portion 132, the amount of the compression spring 134 within the sleeve cavity 606 increases or decreases proportional to the amount of compression. One effect that the length of the sleeve portion has is that the sleeve length 610 determines the amount of travel possible within the hollow portion 132. As the sleeve length 610 approaches the hollow portion length 602, the amount of potential travel decreases.

Figure 7:
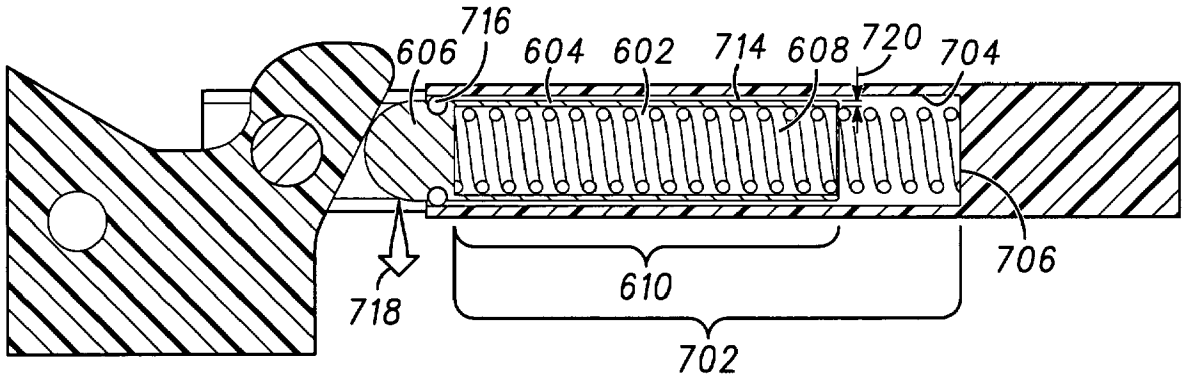
FIG. 7 is an exemplary cross sectional view of a wireless communication device having a hinged portion.

In one exemplary embodiment, a fluid 614 is present in the hollow portion 132 as shown in FIG. 7. The fluid 714 has a dampening affect on the motion of the follower and hence the cover 110 as the cover 110 rotates relative to the housing portion 120. The fluid 714 forms a layer between a sleeve outer wall 618 and a hollow portion inner wall 704. The thickness of the fluid layer 720 is a function of the distance between the sleeve outer wall 618 and the hollow portion inner wall 704, which can also be varied to affect the dampening. The viscosity of the fluid 714 can be selected to achieve the desired dampening effect, i.e. more dampening or less dampening. The sleeve length 610 will also have an interactive effect with the fluid viscosity and both can be adjusted to achieve the desired motion or dampening effect. Additionally, the sleeve length 610 can be set to couple with the hollow cavity end 706 to prevent the compression spring 134 from compressing further than a desired compression point and consequently stop motion of the cam assembly in one direction. The fluid 714 can be any number of materials typically used for dampening, such as oil or grease or any other material either with similar effective dampening effect or viscosity known to those skilled in the art. A seal 716 at the point of intersection between the sleeve portion 604 and the rounded portion 606 prevent the fluid from escaping the system at the follower end. The hollow portion 132 is closed at hollow portion end 706 opposite the seal 716 such that the fluid 714 will not escape the other end. This seal can be a rubber boot that is formed over the hollow portion 132 without the need for a o-ring in none embodiment or a typical o-ring seal. The embodiment shown has an o-ring around the sleeve follower at the intersection of the round portion 606 and the sleeve portion 604.

Figure 8:
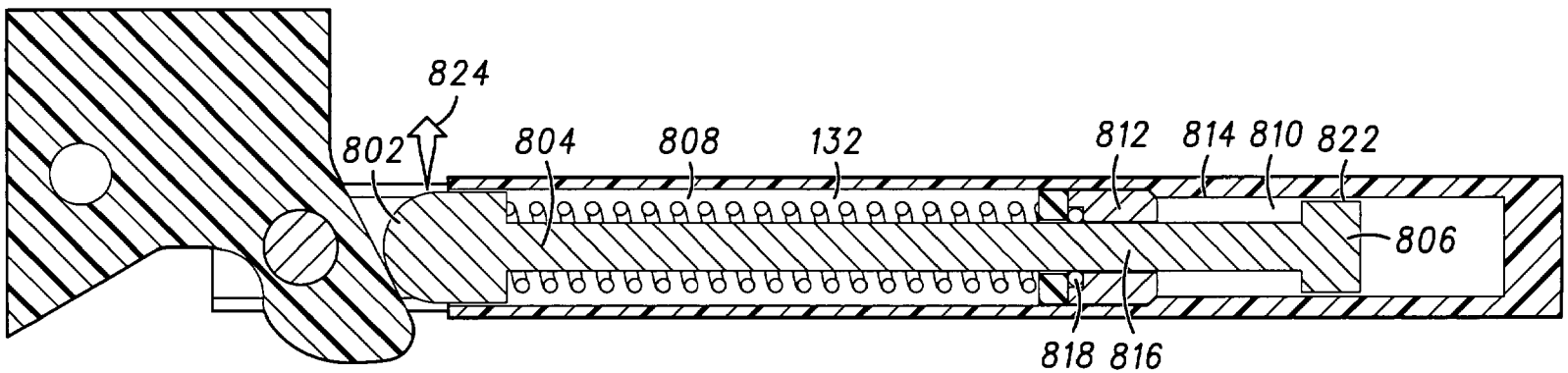
FIG. 8 is an exemplary sectional view of hinge portion follower.

In another embodiment, shown in FIG. 8, the follower has a rounded portion 802, similar to the rounded follower 606 in FIG. 6, a follower shaft 804 and a piston 806. The hollow portion 132 is divided into two portions, a spring chamber 808 and a piston chamber 810. A divider 812 separates the spring chamber 808 and the piston chamber 810. The divider 812 has a follower shaft opening 814 that allows the follower shaft 804 to travel longitudinally within the hollow portion 132. The piston chamber 810 has a fluid 820 as discussed in concert with FIG. 6 that interacts with the piston 806 to dampen the motion of the piston 806 and hence the follower. The dampening effect is a function of the size of the piston 806, the size of the gap in between the piston 806 and the piston chamber inner wall 814. Further, as discussed above, the viscosity of the fluid 820 also has an effect on the degree of the dampening. At the opening 816 of follower shaft 804, there is a seal 818 that prevents the fluid 820 from leaking out of the piston chamber 810. This seal 818 can be an o-ring made of rubber, plastic or a composite material suitable to prevent the fluid 818 from escaping from the piston chamber 810. The seal may also be any other type of seal or method of sealing as those skilled in the art will readily appreciate.

In one exemplary embodiment, the piston moves longitudinally within the piston chamber 810 as the rounded portion 802 of the follower follows along the cam surface 142 during rotation of the cover 110. The fluid 820 in the piston chamber 810 dampens the motion of the cam follower assembly and hence the cover 110. The interaction of the compression spring and fluid 818 characteristics can be controlled to create the desired movement of the cover 110 via the cam follower assembly. As discussed, in at least the illustrated embodiment the dampening effect is a function of the size of the gap between the piston wall 822 and the inner wall 814 of the hollow portion 132 in combination with the viscosity of the fluid 820.

Figure 9:
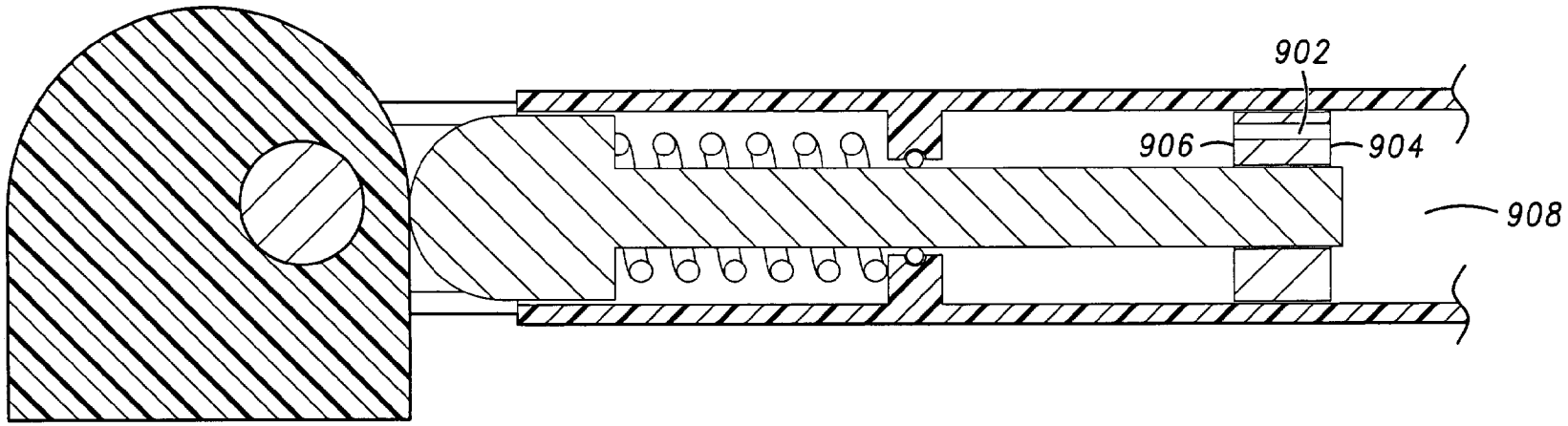
FIG. 9 is an exemplary cross sectional view of a hinge follower.

In another embodiment, shown in FIG. 9, an orifice 902 in the piston 906, extends from a first piston end 904 and the second piston end 906. Fluid 908 travels through the orifice 902. The rate at which and the volume of fluid 908 that passes through the orifice 902 is a function of the size of the orifice 902 and the viscosity of the fluid 908. As with the size of the gap between the inner wall 914 of the hollow portion 132 and the piston wall 922 discussed above, the dampening effect is a function of the orifice size.

It should also be noted, as one skilled in the art of cam followers assemblies will appreciate, that the follower does not necessarily need to be completely rounded, or hemispherical, as provided in connection with at least one of the illustrated embodiments or need to be a ball bearing in another embodiment. These are merely exemplary embodiments of the invention. However, it may be beneficial for the follower to more easily traverse the cam surface 142 in order to create the desired effect. In the embodiment having a ball bearing 336, the ball bearing 336 is seated in the end of the compression spring 134. The diameter of the compression spring 134 is smaller than the ball bearing 336 so that the ball bearing 336 seats in the compression spring end and does not pass through the compression spring end.

The contour of the cam surface 142 can be designed to accommodate a plurality of motions or motion profiles by the cover 110. This is achieved by adjusting the slope of the contoured surface portion at various locations along the contour surface portion. The slope is designed to have a first angle, which in combination with the follower force 924, biases the follower against a first side of the second housing portion which rotates the second housing portion in a first direction of rotation about the first axis. The contoured surface portion may also have a second slope or angle, relative to the first housing portion, which urges the follower against a second side of the second housing portion which rotates the second housing portion in a second direction of rotation about the first axis. The magnitude of the follower force, and proportionally the speed and acceleration of the rotation, is a function of the distance between the first axis and the contour surface portion, which is in contact with the follower.

Figure 10:
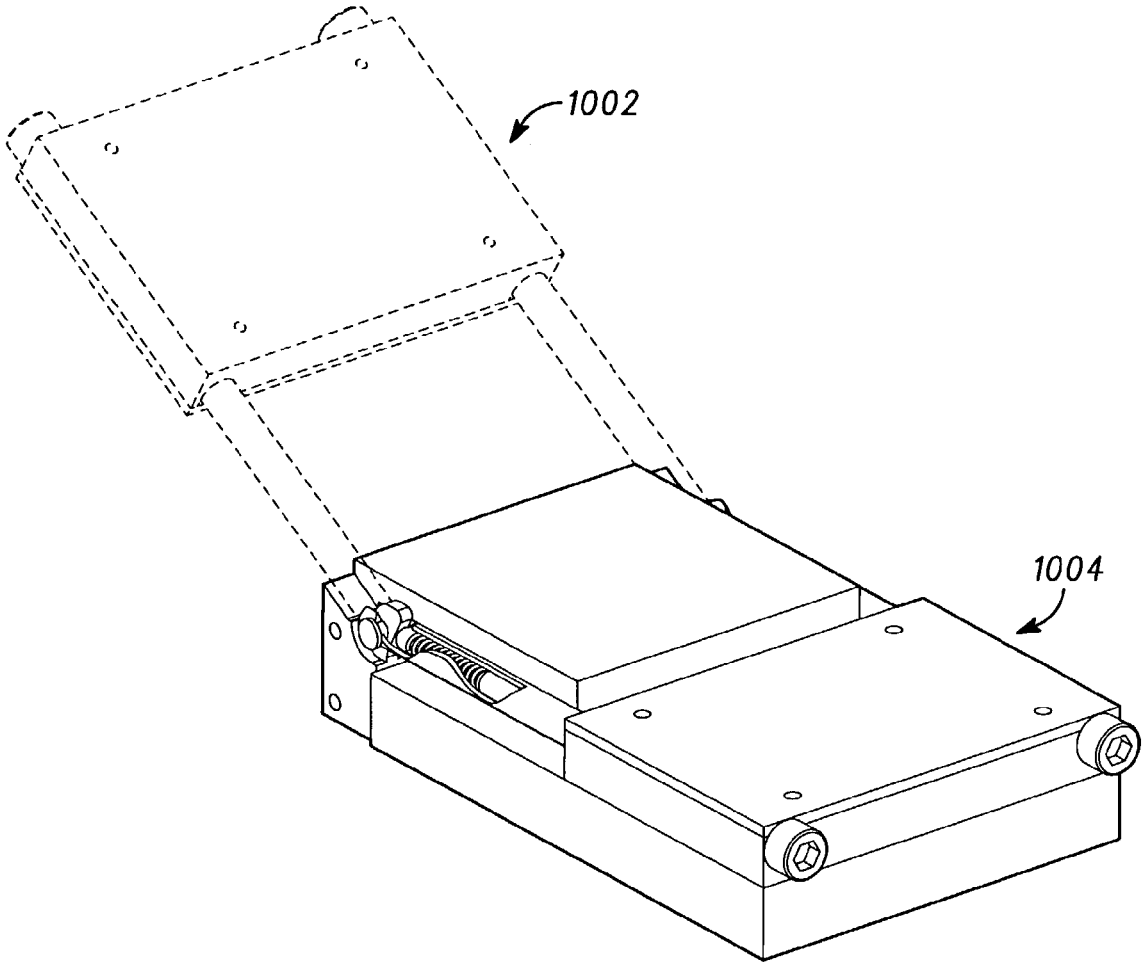
FIG. 10 is an exemplary view of an electronics device having a hinge.
Figure 11:
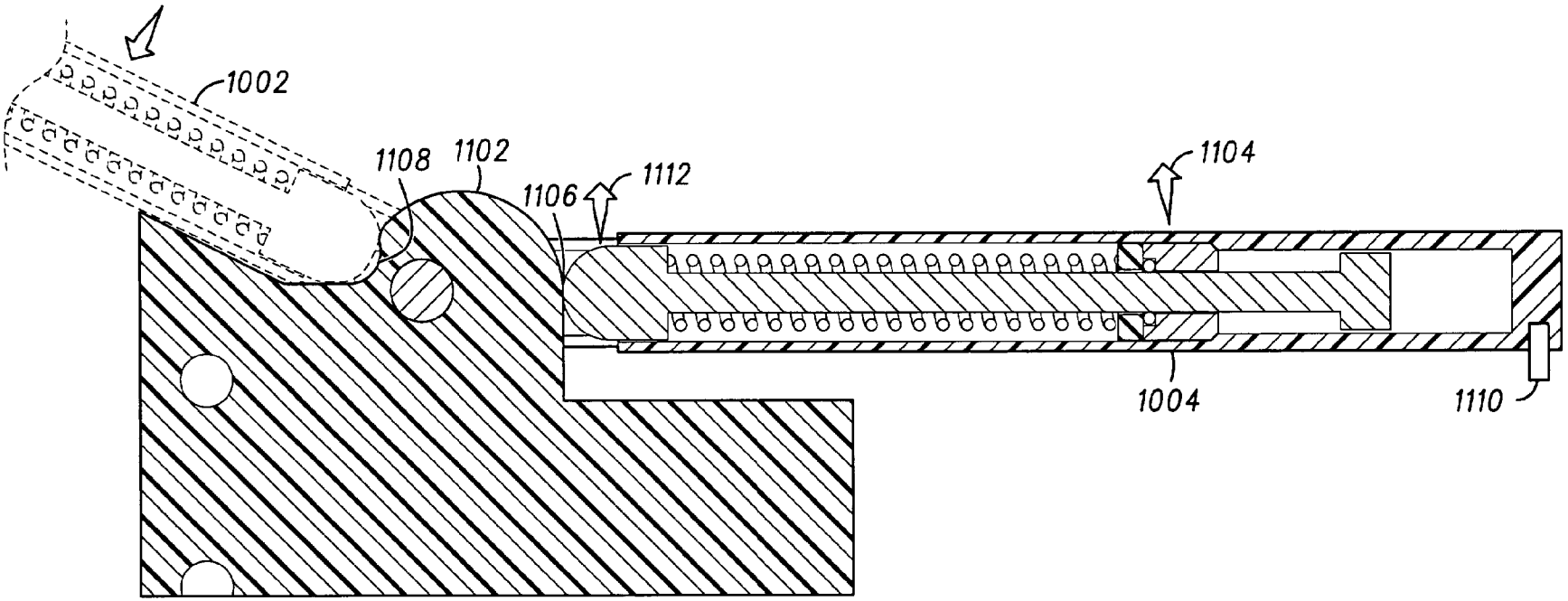
FIG. 11 is an exemplary cross sectional view of a hinge follower.

In at least one embodiment, shown in FIG. 10 and FIG. 11, the cam surface 1002 can be designed such that the cover 110 is constantly biased toward the open position 1002 by the cam follower assembly, even in the closed position 1004. This is achieved by at least one exemplary contour of the cam surface 142, shown in FIG. 10. Here the compression spring 134 urges the ball bearing 336 to move along the cam surface 142 from the first position 1106 to the second position 1108, which corresponds to the closed position 1004 and the open position 1002, respectively. In this embodiment, the cover 110 may be secured in the closed position 1004 by a latch 1110 which when the latch 1110 is released, the cam follower assembly urges the follower from the first position 1106 toward the second position 1108 as a result of the follower force 1112 the cover 110 unassisted by the user to the open position 1004 relative to the housing portion 110.

In another embodiment, the cam surface 142 causes the cover 110 to be urged to the open position 1004. As the cover 110 approaches the open position 1004, the slope of the cam surface 142, in combination with the inherent friction, causes the cover 110 to decelerate in order to come to a smoother stop as opposed to snapping to the open position 1004 at a high rate of speed. The addition of the dampening sleeve follower 602, the dampening piston 806 and the fluid, or any combination thereof, can further vary the speed, acceleration and deceleration of the cover 110. A detent in the contour surface provides a resting point for the follower to lock into. In one embodiment, shown in FIG. 11, the detent is aligned with the second position 1108.

In the illustrated embodiment of FIG. 10, the cover 110, attached by two arms extending from the cover 110 to the first housing portion 120, has a cam follower assembly in each arm. This provides greater control and force over the motion of the cover relative to the first housing portion 120. A greater force may be required for covers having greater mass which can result from the cover 110 having a significant amount of electronic circuits or input/output devices located therein or attached thereto. In this embodiment, a second contoured surface portion is coupled to the first housing portion or formed therein. A third housing portion, which is the second arm, is pivotally coupled to the first housing portion, wherein the third housing portion also pivots about the first axis relative to said first housing portion. A second yielding element, or spring, is disposed in the third housing portion and a second follower is coupled between the second contoured surface portion of the second protruding support member and the second yielding element. The second follower is urged against the second contoured surface portion by force produced by the second yielding element and the follower is urged against a side of the third housing portion by a force produced by the second contoured surface portion. The second contour surface portion may be separate from the first contoured surface portion or an extension thereof. Additionally, either contoured surface portion may be a cam fixed in place relative to the first housing portion.

Figure 12:
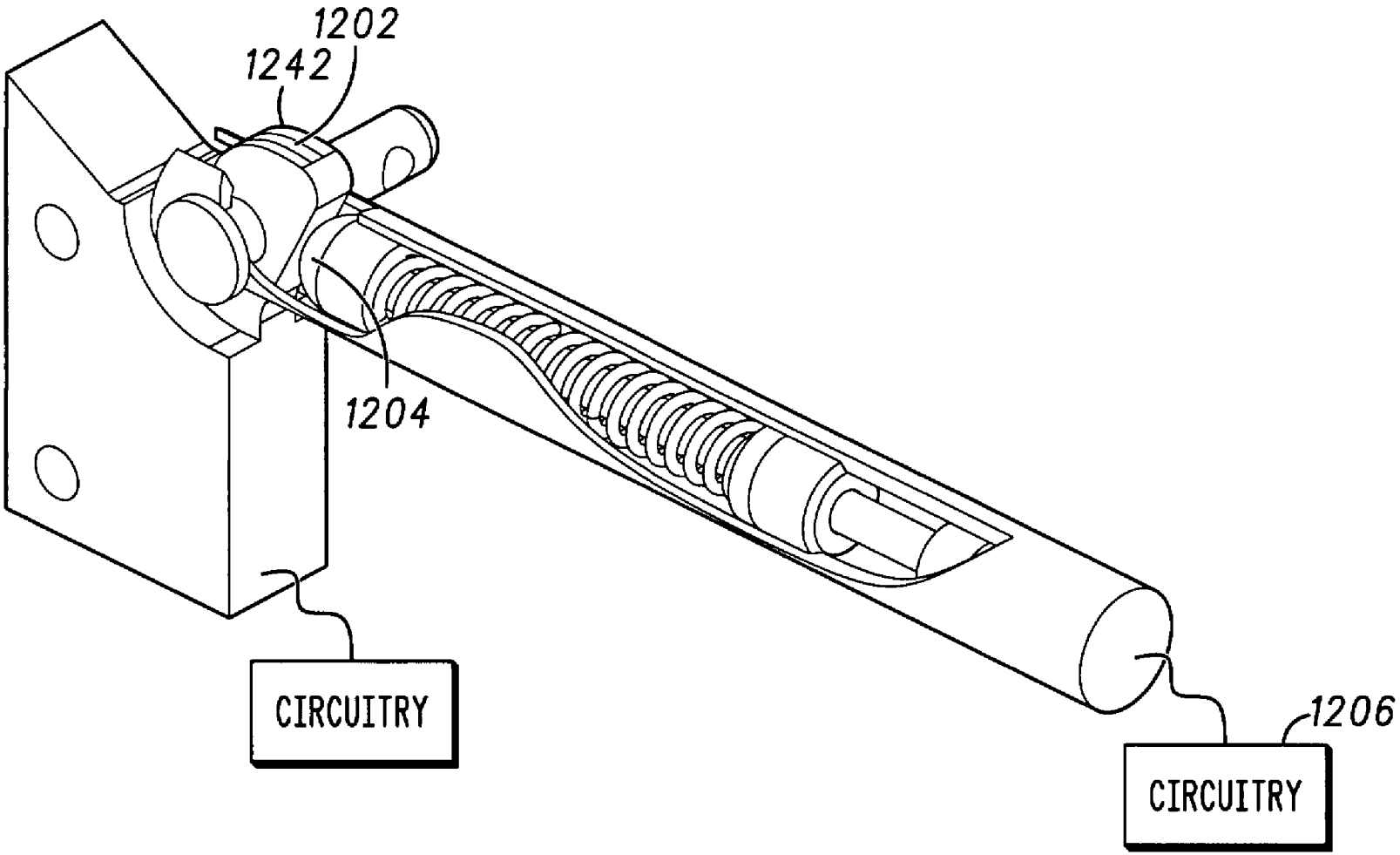
FIG. 12 is an exemplary perspective view of a hinge portion having electrical connections.

In one embodiment, where electrical connections must run from the housing portion 120 to the cover 110, the compression spring 134 the follower, and the interface thereof is used to carry the electrical signals. FIG. 12 shows the cam surface 1242 electrically coupled to the circuitry enclosed in the housing portion 120. The cam surface 1242 has a conductive cam portion 1202 to make an electrical connection with the follower 1204. The follower 1204 is also conductive and makes an electrical connection to the conductive cam portion 1202. The conductive follower 1204 is coupled to circuitry 1206 or a user interface in the cover 110. A wire or conducting trace couples the conducting surface of the follower to the circuitry in the cover. In one embodiment the follower is electrically coupled to the spring and the spring is electrically coupled to the electronic components. The ball bearing follower is constantly coupled to the compression spring and therefore maintains the electrical connection.

Where the embodiment provides a two-arm cover with one arm comprising the cam follower assembly, the second arm may be used to route electrical connections through a hollow portion thereof. This can be a single wire, multiple wires, flexible circuits or any combination thereof, which are limited only by the size of the hollow portion. In another embodiment, which has a two-arm cover and correspondingly a cam follower assembly in each, each cam follower assembly can be used to provide a pair of electrical pathways from housing to the cover 110.

In another embodiment, multiple followers enclosed within the hollow portion 132 couple to the cam surface 142. Each follower couples to the cam surface 142 within a portion of a given range, during which only the desired conductive cam surfaces is coupled to the follower.

While the present inventions and what is considered presently to be the best modes thereof have been described in a manner that establishes possession thereof by the inventors and that enables those of ordinary skill in the art to make and use the inventions, it will be understood and appreciated that there are many equivalents to the exemplary embodiments disclosed herein and that myriad modifications and variations may be made thereto without departing from the scope and spirit of the inventions, which are to be limited not by the exemplary embodiments but by the appended claims.

What is claimed is:

1. An apparatus having a hinge useable in a portable electronic device comprising:

a first housing portion having a contoured surface portion wherein said first housing portion is capable of enclosing electronic circuitry;

a second housing portion pivotally coupled to said first housing portion, said second housing portion pivoting relative to said first housing portion about a first axis;

a yielding element coupled to said second housing portion exerting a yielding element force in at least a first direction; and a follower coupled between said yielding element and said contoured surface portion wherein said follower traverses said contoured surface portion as a result of the yielding element force and the angle of the slope of the contoured surface portion relative to the direction of the yielding element force, wherein said contour surface portion has a contour surface electrical conducting portion, wherein said follower has an follower electrical conducting portion, and wherein said contour surface electrical conducting portion couples to said follower electrical conducting portion at at least one position of rotation of said first housing portion relative to said second housing portion to form an electrical path for carrying electrical signals from said first housing portion to said second housing portion.

2. The apparatus of claim 1, wherein said follower is urged against a side of said second housing portion by a follower force resulting from said yielding element force and said slope of said contoured surface portion relative to said first direction of said yielding element force such that said second housing portion rotates about said first axis relative to said first housing portion.

3. The apparatus of claim 2, wherein a first slope of said contoured surface portion, relative to said first direction of said yielding element force, creates a first reactive contoured surface portion force urging said follower against a first side of said side of said second housing portion thereby rotating said second housing portion in a first direction of rotation about said first axis, and wherein a second slope of said contoured surface portion, relative to said yielding element force, creates a second reactive contoured surface portion force urging said follower against a first side of said side of said second housing portion thereby rotating said second housing portion in a second direction of rotation about said first axis.

4. The apparatus of claim 2, wherein the magnitude of said follower force is a function of a distance between said first axis and said contour surface portion in contact with said follower and wherein the direction of rotation of said second housing portion relative to said first housing portion is a function of a angle of said contoured surface relative to said first housing portion.

5. The apparatus of claim 3, wherein the magnitude of said follower force is a function of a distance between said first axis and said contour surface portion in contact with said follower and wherein the direction of rotation of said second housing portion relative to said first housing portion is a function of a angle of said contoured surface relative to said first housing portion.

6. The apparatus of claim 3, wherein said follower force is substantially parallel to said contoured surface portion.

7. The apparatus of claim 3, wherein said yielding element is disposed in said second housing portion at angle substantially perpendicular to said first axis.

8. The apparatus of claim 3, wherein said contoured surface portion is a cam coupled to said first housing portion and adapted to engage said follower.

9. The apparatus of claim 3, wherein said yielding element is a compression spring wherein said compression spring further comprises:

a first end adapted to receive said follower; and a second end opposite said first end, said second end fixed to a portion of said second housing portion.

10. The apparatus of claim 9, wherein said follower is a ball bearing rollably coupled to and partially seated in said first end of said compression spring.

11. The apparatus of claim 10, wherein said ball bearing is coupled between said contour surface portion and said compression spring, wherein said ball bearing rolls along said contour surface portion during rotation of said first housing portion relative to said second housing portion about said first axis.

12. The apparatus of claim 10, wherein the second housing portion partially encloses said contour surface portion.

13. The apparatus of claim 3, further comprising:

a second contoured surface portion of said first housing portion;

a third housing portion pivotally coupled to said first housing portion, said third housing portion pivoting about a first axis relative to said first housing portion;

a second yielding element disposed in said third housing portion; and a second follower coupled between said second contoured surface portion and said second yielding element said second follower urged against said second contoured surface portion by a second yielding clement force of said second yielding element and said second follower urged transversely along said second contoured surface portion by a second reactive contoured surface portion force of said second contoured surface portion in response to said second yielding element force.

14. The apparatus of claim 13, wherein said second housing element and said third housing element are coupled together.

15. The apparatus of claim 3, wherein said follower further comprises:

a rounded portion adapted to traverse said contour surface portion a follower shaft coupled to said rounded portion and extending into said second housing portion; and a piston coupled to an end opposite to said rounded portion, said piston enclosed in a portion of said second housing portion.

16. The apparatus of claim 15, wherein a hollow portion of said second housing is divided into two portions comprising:

a spring chamber wherein said spring and at least a portion of said shaft are enclosed; and a piston chamber positioned longitudinally adjacent to said spring chamber and adapted to receive said piston and a dampening fluid.

* * * * *